US009723959B2

(12) United States Patent
Suzuki

(10) Patent No.: US 9,723,959 B2
(45) Date of Patent: Aug. 8, 2017

(54) DUST COLLECTOR INTERLOCKING SYSTEM

(71) Applicant: MAKITA CORPORATION, Anjo-shi, Aichi (JP)

(72) Inventor: Hitoshi Suzuki, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 738 days.

(21) Appl. No.: 14/244,267

(22) Filed: Apr. 3, 2014

(65) Prior Publication Data

US 2014/0304939 A1 Oct. 16, 2014

(30) Foreign Application Priority Data

Apr. 10, 2013 (JP) ..... 2013-081857

(51) Int. Cl.
*A47L 9/28* (2006.01)
*A47L 7/00* (2006.01)

(52) U.S. Cl.
CPC ..... *A47L 7/0095* (2013.01); *A47L 9/28* (2013.01); *A47L 9/2857* (2013.01); *A47L 9/2868* (2013.01); *A47L 9/2894* (2013.01)

(58) Field of Classification Search
CPC ..... A47L 9/28; A47L 9/2868; A47L 9/2894; A47L 9/2857
USPC ..... 15/339, 327.6; 340/825.69
See application file for complete search history.

(56) References Cited

U.S. PATENT DOCUMENTS 5,274,878 A * 1/1994 Radabaugh ..... A47L 5/38 15/314
5,606,767 A * 3/1997 Crlenjak ..... A47L 5/38 15/301
5,709,007 A * 1/1998 Chiang ..... A47L 5/225 15/329
5,839,156 A * 11/1998 Park ..... A47L 5/30 15/339
7,900,315 B2 * 3/2011 Cunningham ..... A47L 5/38 15/301
9,108,285 B2 * 8/2015 Usselman ..... A47L 9/2842

FOREIGN PATENT DOCUMENTS

JP H04-30823 A 2/1992
JP A-2004-195565 7/2004
JP 2008-036723 A 2/2008
JP 2012-086342 A 5/2012

OTHER PUBLICATIONS

Jul. 26, 2016 Office Action issued in Japanese Patent Application No. 2013-081857.

* cited by examiner

*Primary Examiner* — Michael Jennings
(74) *Attorney, Agent, or Firm* — Oliff PLC

(57) ABSTRACT

A dust collector interlocking system includes a transmitter provided in the electric power tool and capable of transmitting a radio signal, and a receiver provided in the suction hose of the dust collector and capable of receiving the radio signal from the transmitter of the electric power tool. The transmitter transmits a drive signal of the electric power tool, and the receiver receives the drive signal of the electric power tool from the transmitter to turn on a start switch of the dust collector.

6 Claims, 3 Drawing Sheets

DUST COLLECTOR INTERLOCKING SYSTEM

This application claims priority to Japanese patent application serial number 2013-81857, the contents of which are incorporated herein by reference.

BACKGROUND OF THE INVENTION

Field of the Invention

The present invention relates to a dust collector interlocking system that includes an electric power tool and a dust collector configured to suck machining chips by use of a suction hose. The dust collector can be operated in conjunction with the electric power tool. The machine chips are generated by the processing of materials by an electric power tool, and the dust collector is placed in the vicinity of the electric power tool.

Description of the Related Art

In Japanese Laid-Open Patent Publication No. 2004-195565, a dust collector interlocking system is disclosed. In this system, an adapter is connected to a plug at the distal end of the power cord of an electric power tool such as a circular saw. A transmitter is housed in the adapter. When motor current of the circular saw is detected, the transmitter transmits a drive signal. When the motor current becomes zero, the transmitter transmits an operation stop signal.

Further, in the dust collector, there is provided with a receiver that can receive radio signal from the transmitter of the circular saw. When receiving a drive signal from the transmitter, the receiver turns on the start switch of the dust collector. When receiving an operation stop signal, the receiver turns off the switch.

For this reason, the dust collector can be operated in conjunction with the circular saw by the transmitter and the receiver.

Generally, the dust collector is placed in the vicinity of the circular saw. However, the transmitter of the circular saw is located at the distal end of the power cord, and it follows that the dust collector is located far away from the circular saw. Thus, in order to ensure that the radio signals are received by the receiver, the magnitude of the output from the transmitter must be large to some extent.

However, if there is another dust collector interlocking system in the same work site, large output of the transmitter of the dust collector interlocking system in use may cause malfunction of another dust collector interlocking system.

SUMMARY OF THE INVENTION

Thus, there is a need in the art to ensure that in a first dust collector interlocking system in use, the electric power tool can be operated in conjunction with the dust collector, whereby the operation of the first dust collector interlocking system does not cause the malfunction of a second dust collector interlocking system.

According to a first aspect of the invention, a dust collector interlocking system includes an electric power tool, a dust collector configured to suck machining chips generated by processing of materials by the electric power tool by use of a suction hose, a transmitter provided in the electric power tool for transmitting a radio signal, and a receiver provided in the suction hose of the suction collector for receiving the radio signal. Further, the transmitter transmits a drive signal of the electric power tool, and the receiver receives the drive signal from the transmitter to turn on a start switch of the dust collector.

According to certain embodiments of the present invention, the receiver is provided in the suction hose of the dust collector. When the dust collector is used, the suction hose of the dust collector is placed in the vicinity of the electric power tool. As a result, the receiver of the dust collector is placed near the transmitter of the electric power tool. Thus, even if the radio signal of the transmitter is weak, the receiver can still receive the radio signal.

Further, by using a weak radio signal in the transmitter of the electric power tool, its use will not interfere with the operation of a second interlocking system situated nearby.

According to another aspect of the invention, the receiver is placed at the distal end of the suction hose of the dust collector. For this reason, it is possible to minimize the distance between the transmitter of the electric power tool and the dust collector.

According to another aspect of the invention, the distance at which the receiver can receive the radio signal transmitted from the transmitter is configured to be substantially equal to the length of the suction hose of the dust collector.

For this reason, even if another interlocking system is used on the same work site, there is little possibility that the electric power tool in use might cause a malfunction in another interlocking system. Further, should the receiver be placed near the dust collector main body in order to reduce a wiring length between the receiver and the dust collector main body (for example, near the proximal end portion of the suction hose), the receiver can still receive the radio signal.

According to another aspect of the invention, the transmitter may be adjusted such that a distance that the transmitter can transmit radio signal is configured to be substantially equal to the length of the suction hose of the dust collector. For this reason, the output of the transmitter can be decreased and power consumption can be suppressed.

According to another aspect of the invention, the electric power tool has a trigger-type start switch to be pulled by a finger, and during such the transmitter transmits a drive signal of the electric power tool.

For this reason, as compared with the system in which driving of the electric power tool is detected by the current flowing through the electric circuit of the electric power tool, erroneous detection can be eliminated.

According to another aspect of the invention, the transmitter can be attached to and removed from the electric power tool.

According to another aspect of the invention, the receiver can be attached to and removed from the suction hose of the dust collector.

For this reason, it is possible for a person who does not need to interlock the electric power tool with the dust collector to remove the transmitter and the receiver, and thus costs can be reduced.

According the above, it is ensured that the electric power tool can be operated in conjunction with a dust collector in the dust collector interlocking system, and that it will not cause the malfunction of a second dust collector interlocking system.

BRIEF DESCRIPTION OF TEE DRAWINGS

DETAILED DESCRIPTION OF THE INVENTION

Each of the additional features and teachings disclosed above and below may be utilized separately or in conjunction with other features and teachings to provide a dust collector interlocking system. Representative examples of the present teaching, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

A dust collector interlocking system according to an embodiment of the present invention will be described below with reference to FIGS. 1 to 3.

Figure 1:
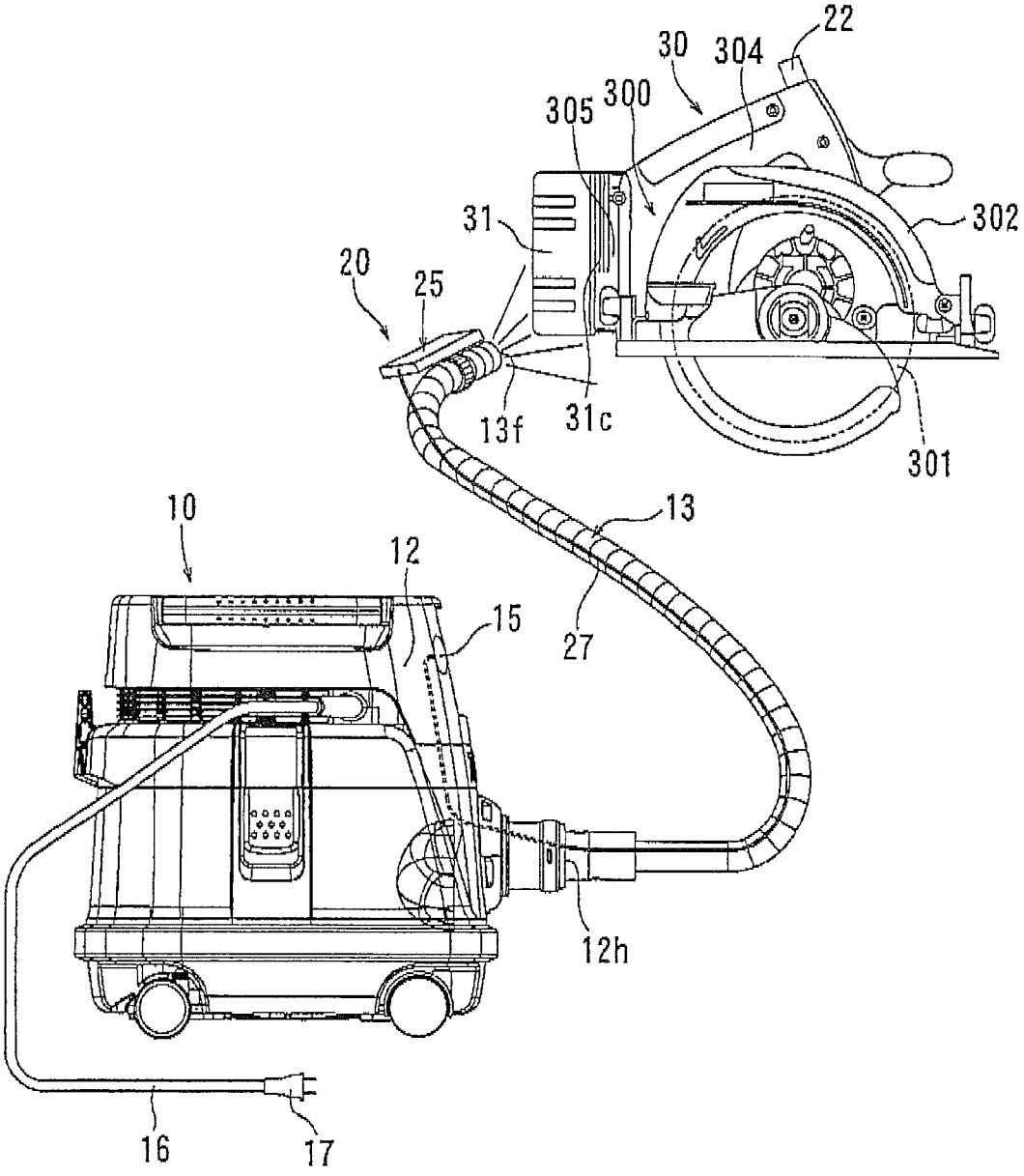
FIG. 1 is an overall view showing a dust collector interlocking system according to an embodiment of the present invention.

As shown in FIG. 1, an interlocking system 20 for the dust collector 10 according to the embodiment is a system to operate an electric power tool, such as a circular saw 30, in conjunction with a dust collector 10. The interlocking system is configured such that machine chips generated by the processing of materials by a circular saw 30 can be efficiently sucked by the dust collector 10. The interlocking system 20 includes a transmitter 22 provided in the circular saw 30 and a receiver 25 provided in the dust collector 10. As shown in FIG. 2, the transmitter 22 wirelessly transmits a drive/stop signal for the circular saw 30. The receiver 25 receives the signal from the transmitter 22 and turn on/off a start switch 15 of the dust collector 10.

As shown in FIG. 1, the circular saw 30 is a portable electric power tool when used to process wood materials etc., and a DC motor 34 (refer to the circuit block diagram of FIG. 2) is housed in a housing 300 of the circular saw 30. A disc-shaped saw blade 301 is rotatably mounted to the housing 300 via a bearing, and a rotational force of the DC motor 34 is applied to the saw blade 301 via a gear mechanism (not shown). Further, the outer circumferential edge of the saw blade 301 is covered with a blade case 302. When wood material is processed, the blade case 302 is pushed by the wood material and caused to turn, and the saw blade 301 is exposed on the outside of the blade case 302.

The housing 300 of the circular saw 30 is provided with a handle portion 304, which can be held by a user. Further, there is provided a trigger-type start switch 32 (refer to FIG. 2), which can be pulled by a finger hooked to the handle portion 304. Further, at an end portion of the housing 300, there is provided a slide-type battery connection portion 305 in a vertical direction. A connection portion 31*c* of a battery pack 31*c* can be slidably inserted to a battery connection portion 305 downwardly from above, and mechanical and electrical connection between the two portions is made.

When the connection portion 31*c* of the battery pack 31 is connected to the battery connection portion 305 of the circular saw (the housing 300), the voltage of cells 31*s* of the battery pack 31 (the battery voltage) is applied to a positive terminal Pt and a negative terminal Nt via a positive terminal. Pb and a negative terminal Nb. This is shown in FIG. 2. The start switch 32, the DC motor 34, and a motor control circuit 35 are connected in series to a power line 30*p* from the positive terminal Pt to the negative terminal Nt of the circular saw 30.

The motor control circuit 35 is configured to control the DC motor 34 by utilizing a switching element and operates based on a signal from a microprocessor 33.

Figure 2:
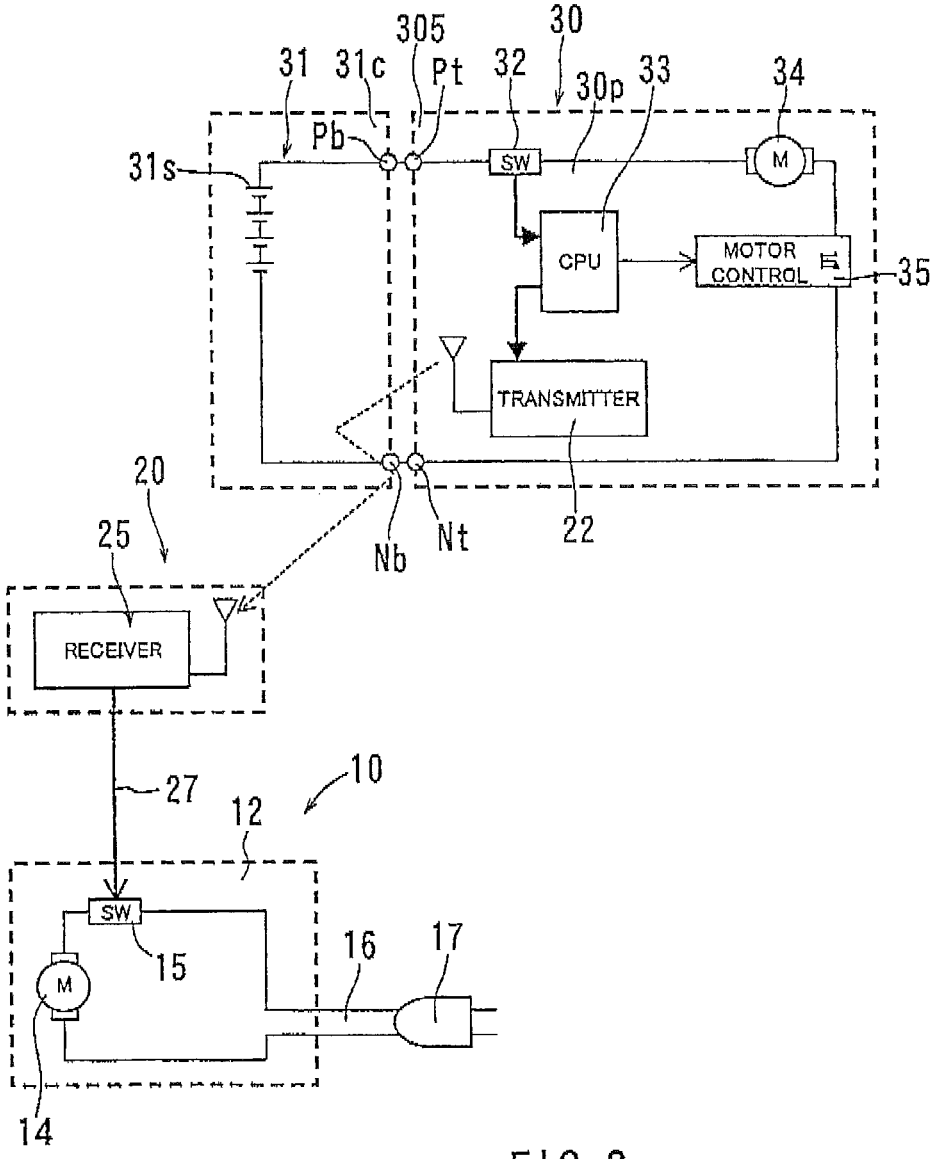
FIG. 2 is a circuit block diagram showing the dust collector interlocking system according to the embodiment.
Figure 3:
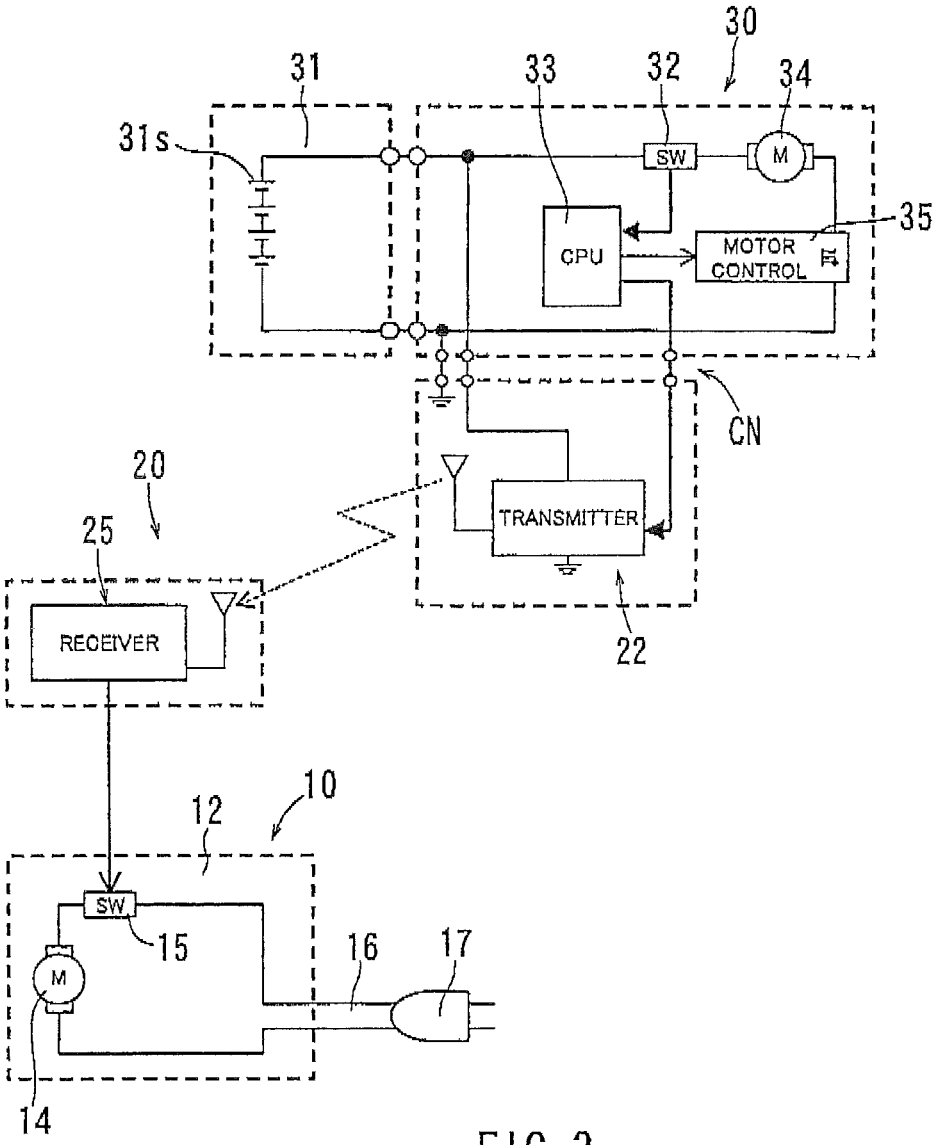
FIG. 3 is a circuit block diagram showing another dust collector interlocking system.

As shown in FIG. 2, the microprocessor 33 controls the motor control circuit 35 based on the signal from the start switch 32, and drives the DC motor 34. That is, when the trigger (not shown) of the start switch 32 is pulled, the microprocessor 33 outputs a signal for driving the DC motor 34. When the trigger of the start switch 32 returns to the original position, the microprocessor 33 outputs a signal to the motor control circuit 35 for stopping the DC motor 34.

Further, as shown in FIG. 2, when the trigger of the start switch 32 is pulled, the microprocessor 33 outputs a drive signal for the DC motor 34 to the transmitter 22 of the interlocking system 20. When the trigger of the start switch 32 returns to the original position, the output of the drive signal to the transmitter 22 is stopped.

As shown in FIG. 1, the transmitter 22 of the interlocking system 20 is provided on the handle portion 304 of the circular saw 30. The transmitter 22 can send the drive signal of the DC motor 34 to the receiver 25 of the dust collector 10. An adjustment is made such that the transmitter 22 can send a radio signal, within a radius range of approximately one meter.

The dust collector 10 includes a dust collector main body 12 and a suction hose 13 connected to a dust collection port 12*h* of the dust collector main body 12. The dust collector main body 12 is configured to rotate a fan (not shown) by an AC motor 14 (refer to FIG. 2) to generate an airflow. This causes external air to be sucked in from outside through the dust collection port 12*h*. The dust collector main body 12 sucks the external air together with dust. After the dust is separated by a filter provided in the dust collector main body 12 (not shown), the sucked air is discharged through exhaust port (not shown). As a result, the dust sucked in from the dust collection port 12*h* accumulates inside the dust collector main body 12.

The dust collection port 12*h* is provided on the front side of the dust collector main body 12. Above the dust collection port 12*h*, there is provided a start switch 15 for starting or stopping the AC motor 14. As shown in FIG. 2, the start switch 15 is connected in series with the AC motor 14, and the start switch 15 and the AC motor 14 are connected to a power cord 16 of a plug 17. That is, by connecting the plug 17 to an outlet (not shown), AC commercial power is supplied to the start switch 15 and the AC motor 14.

As shown in FIG. 1, the suction hose 13 is a flexible hose located at the proximal end portion of which is inserted into the dust collection port 12*h*. External air and dust such as machining chips are sucked through an opening 13*f* at the distal end of the suction hose 13. The suction hose 13 preferably has a length, of approximately one meter.

As shown in FIG. 1, the receiver 25 of the interlocking system 20 is stored in a case and mounted to the distal end of the suction hose 13 with a band. The receiver 25 of the interlocking system 20 is configured to output an ON/OFF signal to the dust collector main body 12 when receiving the radio signal of the transmitter 22 of the circular saw 30, i.e., the drive signal (the drive signal of the circular saw) of the DC motor 34. An output cable 27 of the receiver 25 extends along the suction hose 113 to the dust collector main body 12 and is connected to an electric circuit (not shown) in the dust collector main body 12. As shown in FIG. 2, when the receiver 25 receives a drive signal from the transmitter 22 and produces an ON-output, the electric circuit can turn on the start switch 15 of the dust collector main body 12. When the receiver 25 receives a stop signal from the transmitter 22 and produces an OFF-output, the electric circuit turns off the start switch 15 of the dust collector main body 12.

Next, the operation of the interlocking system 20 for the dust collector 10 will be described below.

As shown in FIG. 1, when the dust collector 10 is used in conjunction with the circular saw 30, the dust collector 10 is placed in close proximity to the circular saw 30. Further, the distal end of the suction hose 13 of the dust collector 10 is located in the vicinity of the material to be processed (not shown). As a result, the distance between the transmitter 22 and the receiver 25 can be within one meter, and this ensures that the receiver 25 will receive the radio signal from the transmitter 22. When the trigger of the start switch 32 of the circular saw 30 is pulled by a user, the microprocessor 33 controls the motor control circuit 35 to drive the DC motor 34 and rotate the saw blade 301. Further, the microprocessor 33 outputs a drive signal to the transmitter 22 corresponding to the drive signal of the start switch 32. Then, the transmitter 22 wirelessly transmits the drive signal to the receiver 25.

When it receives the drive signal from the transmitter 22, the receiver 25 outputs an ON signal to turn on the start switch 15 of the dust collector main body 12. Then, the AC motor 14 of the dust collector main body 12 is started to rotate the fan. Thereafter, external air and dust such as machining chips are sucked in from the distal end of the suction hose 13.

Next, when the trigger of the start switch 32 of the circular saw 30 returns to the original position, the microprocessor 33 controls the motor control circuit 35 to stop the DC motor 34. Further, corresponding to the stop signal of the start switch 32, the microprocessor 33 outputs the stop signal to the transmitter 22. As a result, the transmitter 22 transmits the stop signal to the receiver 25.

When it receives the stop signal from the transmitter 22, the receiver 25 outputs an OFF signal to turn off the start switch 15 of the dust collector main body 12. Then, the AC motor 14 of the dust collector main body 12 is stopped.

In the interlocking system 20 according to the present embodiment, the receiver 25 is provided on the suction hose 13 of the dust collector 10. When the dust collector 10 is used, the suction hose 13 of the dust collector 10 is placed in the vicinity of the circular saw 30. As a result, it follows that the receiver 25 provided on the suction hose 113 of the dust collector 10 is located in close proximity to the transmitter 22 of the circular saw 30. Thus, even if the output of the transmitter 22 of the circular saw 30 is weakened, it is ensured that the receiver 25 of the dust collector 10 receives the radio signal from the transmitter 22 due to the small distance between the two.

Further, since the radio signal of the transmitter 22 of the circular saw 30 can be weakened, even if a second interlocking system is used on, the same work site, there is little possibility that the interlocking system 20 might cause a malfunction in the second interlocking system.

Further, the receiver 25 of the interlocking system 20 is placed at the distal end of the suction hose 13 of the dust collector 10, and thus the distance between the transmitter 22 of the circular saw 30 and the receiver 25 of the dust collector 10 can be minimized.

Further, the distance at which the receiver 25 of the interlocking system 20 can receive the radio signal transmitted from the transmitter 22 is configured to be substantially equal to the length of the suction hose 13 of the dust collector 10, i.e. approximately one meter. Thus, even if another interlocking system is used on the same work site, there is little possibility that the circular saw 30 might cause a malfunction in a second dust collector.

Further, the transmitter 22 of the interlocking system 20 is adjusted such that the output signal of the transmitter 22 can be received by the receiver 25 over a distance substantially equal to the length of the suction hose 13. Thus, the magnitude of the output of the transmitter 22 can be reduced as much as possible, and power consumption can be reduced. Further, even when the receiver 25 is placed near the dust collector main body 12 in order to reduce a wiring length between the receiver 25 and the dust collector main body 12 (for example, near the proximal end portion of the suction hose 13), it is ensured that the receiver receives the radio signal.

Further, the circular saw 30 includes the trigger-type start switch 32 to be operated by a finger, and the transmitter 22 can transmit the drive signal of the circular saw 30 when the start switch 32 is pulled. Thus, as compared with the system in which driving of the circular saw 30 is detected by the current flowing through the electric circuit of the circular saw 30, erroneous detection can be eliminated.

The present invention is not limited to the above-described embodiments, and can be modified without departing from the scope of the present invention. In the present embodiment, the transmitter 22 of the interlocking system 20 is integrated with the circular saw 30, as shown in FIGS. 1 and 2. However, as shown in FIG. 3, it is possible to prepare the transmitter 22 separately from the circular saw 30 and connect the transmitter 22 to the circular saw 30 by a connector CN. This makes it possible to sell the circular saw 30 without the transmitter 22 to a person who uses the circular saw 30 in an environment where no dust collector 10 is required and this can reduce the sales cost of the circular saw 30. Further, the receiver 25 of the interlocking system 20 is attached to the suction hose 13 of the dust collector 10 by means of a band, and thus it is possible to sell the dust collector 10 without the receiver 25 to a person who does not use the interlocking system 20.

Further, in the present embodiment, the transmitter 22 of the circular saw 30 transmits the stop signal to the receiver 25 when the trigger of the start switch 32 of the circular saw 30 returns to the original position. However, it is possible to transmit the stop signal when a predetermined period of time has passed after the start switch 32 of the circular saw 30 returns to the original position.

Further, in the present embodiment, when the receiver 25 receives the stop signal, the start switch 15 of the dust collector main body 12 is turned off to stop the AC motor 14. However, it is possible to turn off the start switch 15 of the dust collector main body 12 after a predetermined period of time has passed after the receiver 25 receives the stop signal.

Further, in the present embodiment, the suction hose 13 of the dust collector 10 has a length of approximately one meter, and the output of the transmitter 22 of the interlocking system 20 is adjusted such that the signal can be transmitted and received within approximately one meter. However, it is possible to adjust the length of the suction hose 13, corresponding to the transmittable range of the radio signal in conformity with the length of the suction hose 13.

Further, in the present embodiment, the output cable 27 of the receiver 25 of the interlocking system 20 extends along the suction hose 13 of the dust collector 13. However, it is possible to embed the output cable 27 of the receiver 25 in the wall of the suction hose 13. Further, it is also possible to use wireless communication.

Further, in the present embodiment, the circular saw 30 is exemplified as the electric power tool. However, the present invention is also applicable to various electric power tools other than the circular saw 30, such as an electric drill, an electric grinder, an electric reciprocating saw, an electric jig saw, an electric cutter, an electric chain saw, and an electric power plane.

I claim:

1. A dust collector interlocking system, comprising:

an electric power tool;

a dust collector configured with a suction hose to suck machining chips generated by processing of materials by the electric power tool;

a transmitter for transmitting a radio signal, the transmitter provided in the electric power tool; and a receiver for receiving the radio signal from the transmitter, the receiver provided at a distal end of the suction hose of the dust collector, wherein:

the transmitter transmits a drive signal of the electric power tool; and the receiver is configured to turn on a start switch of the dust collector when it receives the drive signal from the transmitter in a case where a distance from the transmitter provided in the electric power tool to the receiver provided at the distal end of the suction hose of the dust collector is less than a length of the suction hose of the dust collector and also is less than a wiring distance from the receiver to the start switch.

2. The dust collector interlocking system according to claim 1, wherein a distance by which the receiver can receive the radio signal transmitted from the transmitter is configured to be substantially equal to the length of the suction hose of the dust collector.

3. The dust collector interlocking system according to claim 1, wherein the transmitter is adjusted such that a distance from which the transmitter can transmit the radio signal is configured to be substantially equal to the length of the suction hose of the dust collector.

4. The dust collector interlocking system according to claim 1, wherein:

the electric power tool has a trigger-type start switch which can be pulled by a finger, and the transmitter transmits the drive signal of the electric power tool when the trigger-type start switch is pulled.

5. The dust collector interlocking system according to claim 1, wherein the transmitter can be attached to and removed from the electric power tool.

6. The dust collector interlocking system according to claim 1, wherein the receiver can be attached to and removed from the suction hose of the dust collector.

* * * * *